United States Patent [19]

Friese et al.

[11] 3,990,904

[45] Nov. 9, 1976

[54] METHOD FOR THE PREPARATION OF XYLOSE SOLUTIONS

[75] Inventors: Hermann Friese, Berlin; Hans Buckl, Freising; Bernd Brenner, Moosburg, all of Germany

[73] Assignee: Sud-Chemie AG, Munich, Germany

[22] Filed: May 11, 1976

[21] Appl. No.: 685,369

[52] U.S. Cl. ..... 127/37; 260/124 R; 260/635 C

[51] Int. Cl.[2] ..... C13K 13/00; C13K 1/02

[58] Field of Search..... 127/37; 260/124 R, 124 A

[56] References Cited

UNITED STATES PATENTS

| | | | |
|---|---|---|---|
| 2,615,883 | 10/1952 | Sweeny | 127/37 |
| 2,801,955 | 8/1957 | Rutenberg | 127/37 X |
| 2,835,611 | 5/1958 | Snyder | 127/37 |
| 3,212,933 | 10/1965 | Hess | 127/37 |
| 3,251,716 | 5/1966 | Porter | 127/37 |
| 3,565,687 | 2/1971 | Suminoe | 127/37 |
| 3,579,380 | 5/1971 | Friese | 127/37 |
| 3,784,408 | 1/1974 | Joffe | 127/37 |
| 3,787,241 | 1/1974 | Eickemeyer | 127/37 |
| 3,817,826 | 6/1974 | Nygard | 260/124 A |

*Primary Examiner*—Morris O. Wolk
*Assistant Examiner*—Sidney Marantz
*Attorney, Agent, or Firm*—Watson Leavenworth Kelton & Taggart

[57] ABSTRACT

A method for the preparation of xylose solutions from oat husks which comprises:

a. hydrolyzing oat husks with a solution of alkali metal hydroxide to provide oat husks from which the chemically bound acetic acid originally present therein has been substantially completely removed, and a solution of acetic acid, provided, that a quantity of not less than one mole, and not more than two moles, of said solution of alkali metal hydroxide is used per mole of acetic acid originally present in the oat husks;

b. recovering the oat husks from which the chemically bound acetic acid has been substantially removed; and c. hydrolyzing the oat husks of step (b) with a mineral acid to provide a solid residue containing lignin and an acidic solution of D-(+)-xylose.

4 Claims, No Drawings

METHOD FOR THE PREPARATION OF XYLOSE SOLUTIONS

BACKGROUND OF THE INVENTION

1. Field of the Invention

This invention relates to methods for hydrolyzing oat husks to provide D-(+)-xylose.

2. Description of the Prior Art

D-(+)-xylose and its hydrogenation product, xylitol, are of considerable industrial significance. For example, xylose can be employed for various purposes in the foodstuffs industry, while xylitol has proved to be a very good sweetener for diabetics. Varieties of deciduous timber, such as beech and chestnut, are used almost exclusively as the starting material for the industrial manufacture of xylose. The yields are about 10–12% (compare, for example, German Pat. No. 912,440). It is a significant disadvantage of these processes that the wood material which remains, so-called cellolignin, has hitherto been incapable of practicable industrial utilization and that the process mentioned only gives moderate yields of xylose.

German Pat. No. 834,079 has disclosed the production of xylose from oat husks. Oat husks contain about 38% of pentosan while, for example, beechwood and birchwood only contain 24–25% and maize cobs contain about 28% of pentosans. In this process the oat husks are heated to boiling with 0.08% strength ammonia or are extracted with benzene/alcohol. Thereafter the usual hydrolysis under pressure is carried out with 0.2 to 0.5% strength $H_2SO_4$ at 125° C. Further working up is not carried out. In the pretreatment with $NH_3$, 4 kg of $NH_3$, as an 0.08% strength solution, are used per 1,000 kg of oat husks. However, 17 kg of $NH_3$ would be necessary to split off the acetic acid. Furthermore, under the conditions mentioned in German Pat. No. 834,079, it is likely that hardly any splitting off, and hence removal, of the acetic acid, which accounts for approximately 6% of the weight of the oat husks, takes place.

The pending U.S. Patent applicaton Ser. No. 523,456 of Hermann Friese, filed Nov. 13, 1974, discloses a method for the preparation of xylose solutions from oat husks which is characterized in that the hydrolysis is carried out upon the oat husks with alkali metal hydroxide or alkali metal chlorite in a first stage to remove substantially all of the chemically bound acetic acid originally present therein and hydrolyzing the acetic acid-free oat husks with a mineral acid in a second stage to provide a residue containing lignin and an acidic solution of D-(+)-xylose. Using the method, the xylose can be recovered as such or converted in situ to xylitol. The solid residue by-product of the aforesaid process for the hydrolysis of oat husks, following removal of the lignin content thereof, is also readily convertible to cellulose.

SUMMARY OF THE INVENTION

It has been surprisingly discovered that if the amount of alkali metal hydroxide reacted with the oat husks in the first hydrolysis step of the method disclosed in U.S. patent application Ser. No. 523,456, supra, is within the range of not less than 1 mole nor more than 2 moles per mole of acetic acid orginally present in the oat husks, the production of xylose will be significantly improved. Using the method according to the invention, xylose solutions are obtained containing only a small amount of acetic acid so that only a few ion-exchangers are required to remove the remaining acetic acid. If on one hand, during the alkaline decomposition of the oat husks, less than 1 mole of alkali metal hydroxide per mole of acetic acid were to be used, then xylose solution would contain larger quantities of acetic acid after the acid hydrolysis than a xylose solution obtained according to the invention. And if on the other hand, more than two moles of alkali metal hydroxide per mole of acetic acid were to be used in the first hydrolysis step, the destruction of the pentosans, and thus a reduction in yield of xylose, would become noticeable.

DESCRIPTION OF THE PREFERRED EMBODIMENTS

Preferably, 1.1 to 1.2 moles of alkali metal hydroxide are used per mole of chemically bound acetic acid orginally present in the oak husks. Sodium and potassium hydroxide, especially sodium hydroxide are preferred. The method can be carried out, for example, in aqueous solution. When working under normal pressure, then the concentration of the alkali metal hydroxide, relative to the solvent + alkali metal hydroxide, may amount to 0.6 to 4% by weight, for example. The preferred range of concentration extends from 0.6 to 3, especially from 0.6 to 0.8% by weight. The temperature during this step can range from 15° to 100° C. and preferably from 60° to 100° C.

When the working under pressure, then, for example, the alkali metal hydroxide concentrations may range from 0.3 to 1.5% by weight, especially from 0.5 to 1.0% by weight. The most favorable concentration is then 0.66% by weight. The pressure is preferably up to 3 atmospheres gauge, and the temperature preferably up to 125° C. Pressure is generally produced autogeneously in the autoclave.

The oat husks treated in the first stage are subjected in a manner known per se to decomposition in a second stage with a dilute mineral acid at an elevated temperature and with or without the use of pressure, once the acetic acid has been separated from them by filtration.

The decomposition can be carried out for example with $H_2SO_4$, HCl or HBr, for example in water; $H_2SO_4$ is preferred. When working without pressure, 1.5 to 6.0% by weight of HCl or HBr are preferably used, or 1.5 to 6.0% by volume of $H_2SO_4$, and a liquid to solids ratio of 3:6 parts by volume is used. The temperature is increased and is preferably from 50° to 125° C, 2 to 4 hours then being required for the second stage of the inventive method.

When working under pressure then the latter preferably amounts to up to 4 atmosphere gauge, especially 1 to 3 atmospheres gauge, the temperature preferably being between 125° and 135° C. The concentration of acid is preferably from 0.2 to 0.6% by weight of HCl or HBr and from 0.2 to 1.2% by volume of $H_2SO_4$, and the ratio of liquid to solids should preferably be from 4:1 to 7:1 volumes/weight of solids. The time required for this stage is about 1 to 2 hours.

After completion of the second stage of the method, the mixture is filtered. If sulphuric acid has been used in the second stage the mixture can be neutralized with barium carbonate, calcium oxide or preferably with calcium carbonate in the calculated quantity. After separation of the precipitate, a xylose solution is then obtained, which can then be reduced either to xylitol solutions after complete removal of the salts and decolorization onto pairs of ion-exchangers, or can be used to produce xylose.

EXAMPLE 1

1 kg of oat husks containing 34 g of acetic acid (3.4%) is mixed with 4 liters of water in which there are dissolved 25 g of sodium hydroxide. The suspension is stirred for one hour at a temperature of from 80° to 90° C. Suction-filtration is then carried out and the mixture washed well with water until the filtrate, at first cloudy when running off, has become clear. The residue amounts to 729 g (relative to the dry substance) and contains 4.4 g of acetic acid (0.6%).

600 g of this residue (relative to the dry subtance) are heated for 60 minutes together with 1.8 liters of a sulphuric acid solution of 0.8% by volume in the stirrer autoclave up to a temperature of 135° C. After suction-filtration and washing with water, the residue amounts to 348 g and contains 5.1% of pentosan. The acid filtrate is neutralized with the calculated quantity of calcium carbonate while stirring and the calcium sulphate precipitate is separated off.

The xylose solution obtained is freed from salts with cation exchangers and anion-exchangers; 15 liters of hydrolyzed substance can be freed of salts for each liter of cation exchangers and for each liter of anion exchangers used, before the exchangers need to be regenerated. After this, the salt-free solution is decolorized; it is possible to decolorize 45 liters of hydrolyzed substance for each liter of cation exchangers and anion exchangers used. The capacity of the ion-exchangers therefore totals 5.6 liters of hydrolyzed substance per liter of ion-exchangers, 202.5 g of xylose are obtained from the purified hydrolyzed substance. m.p. 144° – 146° C.

COMPARATIVE EXAMPLE

As in the above Example 1 kg of oat husks are used containing 34 g of acetic acid (3.4%). They are mixed with 3 liters of water in which 8.8 g of sodium hydroxide has been dissolved and the suspension obtained is stirred for one hour at a temperature of from 80° to 90° C. Subsequently, suction-filtration is carried out and the mixture is washed well with water until the filtrate, at first running off cloudy, has become clear. The residue amounts to 800 g (calculated on the dry substance) and contains 19.2 g of acetic acid (2.4%).

600 g of this residue (calculated on the dry substance) are heated in the stirrer autoclave for 60 minutes with 1.8 liters of a sulphuric acid of 0.8% by volume up to a temperature of 135° C. After suction-filtered and washing with water, the residue weights 331 g and contains 5.3% of pentosan. In the same manner as described in the above example, the hydrolyzed substance is then freed of salts and decolorized. The capacity of the exchangers in the salt removing process is 12.5 liters of hydrolyzed substance per 1 liter of cation and 1 liter anion exchangers, in the decolorizing process 37 liters of hydrolyzed substance per 1 liter of cation and per 1 liter of anion exchangers, so that a total ion-exchanger capacity of 4.7 liters of hydrolyzed substance per 1 liter of ion-exchangers is attained.

192.6 g of xylose are obtained from the purified hydrolyzed substance; m.p. 144° – 146° C.

What is claimed is:

1. A method for the preparation of xylose solutions from oat husks which comprises:

a. hydrolyzing oat husks with a solution of alkali metal hydroxide to provide oat husks from which the chemically bound acetic acid originally present therein has been substantially completely removed, and a solution of acetic acid, provided, that a quantity of not less than one mole, and not more than two moles, of said solution of alkali metal hydroxide is used per mole of acetic acid originally present in the oat husks;

b. recovering the oat husks from which the chemically bound acetic acid has been substantially removed; and c. hydrolyzing the oat husks of step (b) with a mineral acid to provide a solid residue containing lignin and an acidic solution of D-(+)-xylose.

2. The method of claim 1 wherein the D-(+)-xylose present in the acidic solution of step (c) is recovered therefrom in substantially pure form.

3. The method of claim 1 wherein hydrolysis step (a) is carried out with a solution containing from 1.1 to 1.2 moles of alkali metal hydroxide per mole of acetic acid orginally present in the oat husks.

4. The method of claim 1 wherein hydrolysis step (a) is carried out with a solution of sodium hydroxide, potassium hydroxide or combination thereof.

* * * * *